US006468104B2

(12) United States Patent
Fukase

(10) Patent No.: US 6,468,104 B2
(45) Date of Patent: Oct. 22, 2002

(54) CONNECTOR

(75) Inventor: Yoshihiro Fukase, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/891,354

(22) Filed: Jun. 27, 2001

(65) Prior Publication Data

US 2002/0001988 A1 Jan. 3, 2002

(30) Foreign Application Priority Data

Jun. 29, 2000 (JP) ..... 2000-197362

(51) Int. Cl.[7] ..... H01R 3/00
(52) U.S. Cl. ..... 439/489; 439/358
(58) Field of Search ..... 439/353–358, 439/488, 489, 923

(56) References Cited

U.S. PATENT DOCUMENTS 4,496,213 A * 1/1985 Borsuk ..... 439/489
5,320,556 A * 6/1994 Otaka et al. ..... 439/372
6,065,991 A * 5/2000 Fukuda ..... 439/352

FOREIGN PATENT DOCUMENTS

JP 10-50408 2/1998 ..... H01R/13/639

* cited by examiner

*Primary Examiner*—Khiem Nguyen
(74) *Attorney, Agent, or Firm*—Sughrue Mion, PLLC

(57) ABSTRACT

A connector is configured to include a female connector (11) and a male connector (14) and further includes a locking piece (27) for holding the fitting state where the male connector (14) is fitted into the female connector (11) as well as a slider (13) for biasing the male connector (14) in a direction opposite to the fitting direction by the repulsive force of a coil spring (12) when both the connectors (11, 14) are in a half-fitting state. A locking mechanism portion (24) is provided in adjacent to a male connector insertion portion (15) for coupling the connectors to each other within the female connector housing (17) of the female connector (11). Further, a slider insertion portion 16 and the slider (13) are provided with tapered surfaces (17C, 22) for rotating the slider (13) by a predetermined angle in accordance with the movement of the slider (13) in the fitting direction, whereby the slider (13) can be engaged with the locking piece (27) with in accordance with the rotation of the slider.

6 Claims, 15 Drawing Sheets

CONNECTOR

BACKGROUND OF THE INVENTION

1. Technical Field of the Invention

The present invention relates to a connector and, more particularly, relates to a pair of male and female connectors with locking mechanisms which are fitted to each other to perform electric connection.

2. Related Art

Generally, a connector disclosed in Japanese Patent Laid-Open No. 50408/1998 shown in FIG. 21 is known as such a kind of connector. This connector is formed of a connector 3 having a slider housing portion 2 in which a slider 1 is housed, and a female connector 5 in which the male connector housing 4 of the male connector 3 is fitted. Coil springs 6 and the slider 1 are housed within the slider housing portion 2 of the male connector 3. Stopper projections 7 are protrusively provided at the female connector 5. These stopper projections 7 abut against abutment projections 8 formed at the slider 1 when the male connector 3 is fitted into the female connector 5 to thereby act to push the slider 1 into the slider housing portion 2. When the male connector 3 is half-fitted into the female connector 5, the coil springs 6 act to push back the female connector 5 due to the repulsive force thereof. When the fitting operation is completed, the abutment projections 8 move over the stopper projections 7 of the female connector 5 and so the slider 1 and the coil springs 6 are restored to their initial states. The locking operation of the fitting state between the male connector 3 and the female connector 5 is performed by slanted projection 9A formed at the female connector 5 and a locking arm 9B formed at the male connector 3.

However, according to the aforesaid related connector, since the female connector 5 requires two kinds of projections, that is, the stopper projections 7 and the slanted projection 9A, the housing of the female connector 5 becomes large in its size and complicated in its construction. Thus, the female connector is difficult to be used commonly to a unit to which the male connector 3 is integrally provided, for example. Further, since the locking arm 9B is provided above the male connector 3 and the slider 1 is disposed above the locking arm, there arises a problem that the male connector 3 becomes large in its size and complicated in its construction. Therefore, there also arises a problem that the manufacturing cost of the connectors becomes high.

SUMMARY OF THE INVENTION

Accordingly, an object of the invention is to provide a connector which can be simplified and miniaturized in its configuration and high in general-purpose properties.

To achieve the above objects, according to a first aspect of the invention, there is provided a connector comprising:

a first connector including a connector insertion portion and a slide member insertion portion adjacent to the connector insertion portion;

a second connector to which the first connector is fitted in a fitting direction;

a locking mechanism including a locking member provided at a side portion of the connector insertion portion for holding a sate where the first and second connectors are fitted each other in a fitted state;

a slide member including an elastic member which is provided in and slidable along the slide member insertion portion, wherein the elastic member urges the second connector in a direction opposite to the fitting direction by its repulsive force when the first and second connectors are half-fitted each other in a half-fitted state; and a rotation guide mechanism, for rotating the slide member by a predetermined angle in accordance with a movement of the slide member in the fitting direction, provided at the slide member insertion portion and the slide member, wherein the slide member can be engaged with the locking mechanism in accordance with the rotation of the slide member.

According to first aspect of the invention, since the locking mechanism portion and the slide member insertion portion are adjacently disposed at the side portion of the connector insertion portion in which the second connectors are fitted in the housing of the second connectors, the size of the thickens of the first connector can be prevented from being large, and the configuration of the connector provided with the locking mechanism portion and the slide member insertion portion for detecting the half-fitting state with the locking mechanism portion can be miniaturized. Further, according to the first aspect of the invention, the slider member can convert the linear movement into the rotation movement by the rotation guide mechanism. Thus, the slide member side can be engaged with the locking mechanism side by the rotation of the slide member, so that the half-fitting state of both the connectors can be detected, for example.

According to a second aspect of the invention, in the connector of the first aspect, the slide member includes an abutment projection which abuts against the second connector upon fitting of the first and second connectors and a projection which is engaged with the locking mechanism in accordance with the rotation of the slide member.

Thus, according to the second aspect of the invention, the slide member abuts at its abutment projection against the second connector and inserted within the slide member insertion portion of the first connector. In accordance with this insertion, the slide member rotates and its latching projection is engaged by the locking mechanism side. When the engaging state of the latching projection and the locking mechanism is maintained, the slide member holds the state being pushed into the slide member insertion portion, so that the half-fitting state of the connectors can be detected.

According to a third aspect of the invention, in the connector of the first or second aspect, the rotation guide mechanism is formed by a first guided surface formed at a front end portion of the slide member in the fitting direction and a second guide surface formed at the slide member insertion portion for rotating the slide member in contact with the first guided surface in accordance with sliding movement of said slide member.

According to the third aspect of the invention, since the guided surface of the slide member side slides with the guide surface of the slide member insertion portion side, the guided surface slides with the guide surface to thereby rotate the slide member in accordance with the insertion of the slide member.

According to a fourth aspect of the invention, in the connector of the second aspect, the locking member is formed by a supporting portion formed at a housing of the first connector and a locking piece extended in the fitting direction, the locking piece has a predetermined flexibility for almost integrally swinging front and rear portions of the locking piece with respect to the supporting portion, and includes a latching portion and a projection latching portion which are provided the front portion of the locking piece, the latching portion is engaged with an engagement projection protruded from a housing of the second connector in the fitted state, and the projection latching portion interferes the sliding movement of the slide member in the half-fitted state.

Thus, according to the fourth aspect of the invention, the latching portion of the locking piece constituting the locking mechanism acts to stop the latching projection of the other connector being fitted to hold the fitting state. Further, since the projection latching portion stops the rotated latching projection when both the connectors are in the half-sitting state, the slide member can be prevented from restoring to the initial state to thereby act to recognize that the fitting state has not been completed.

According to a fifth aspect of the invention, in the connector of the fourth aspect, the engagement projection pushes the latching portion in a direction substantially perpendicular to the fitting direction and passes the latching portion therethrough, and the projection of the slide member abuts against the projection latching portion in the half-fitted state.

Thus, according to the fifth aspect of the invention, the engagement projection formed at the housing of the second connector pushes the latching portion of the locking piece in the direction almost perpendicular to the fitting direction in accordance with the fitting of both the connectors, the projection of the slide member likely engages with the projection latching portion of the front end portion of the locking piece. Thus, the slide member can be surely prevented from restoring to the initial state at the time of half-fitting, so that the fitting state can be surely detected.

According to a sixth aspect of the invention, in the connector of the first aspect, the slide member is a cylindrical shape, the elastic member is a coil spring, and the elastic member is inserted from a rear end side of the slider member.

Thus, according to the sixth aspect of the invention, since the slide member is configured in a cylindrical shape, the connector can be miniaturized as compared with the slide member of a rectangular shape. Further, since the elastic member is housed within the slide member, the attachment property is good and the space can be saved.

DETAILED DESCRIPTION OF PREFERRED EMBODIMENT

Figure 1:
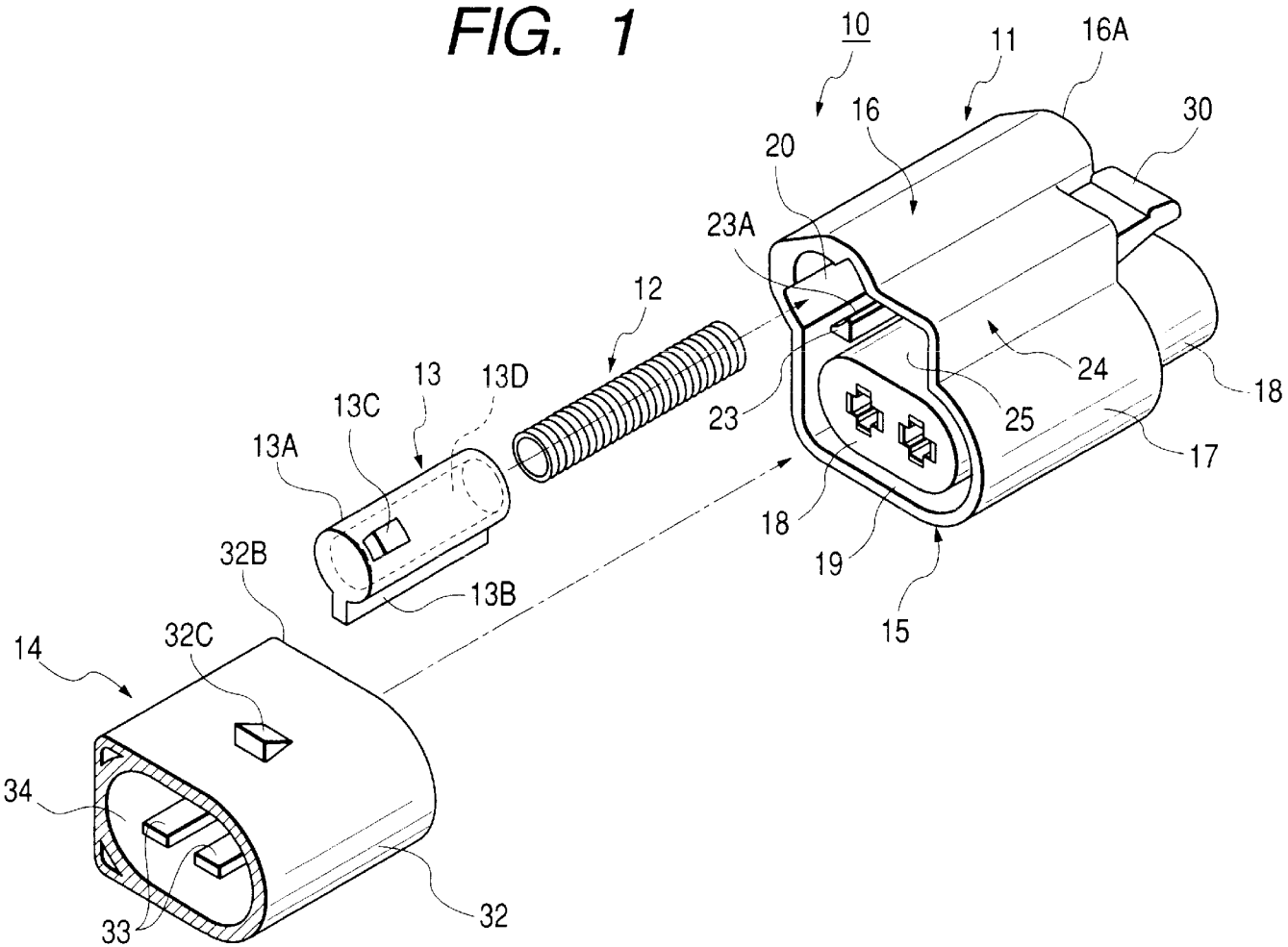
FIG. 1 is an exploded perspective view showing the connector according to an embodiment of the invention.

The connector according to the invention will be explained concretely based on the embodiment shown in the drawings.

FIG. 1 is an exploded perspective view of a connector with a locking mechanism according to the embodiment. As shown in this figure, a connector 10 with a locking mechanism is configured by a female connector 11, a coil spring 12 to be incorporated within the female connector 11, a slider 13 to be incorporated within the female connector 11 together with the coil spring 12, and a male connector 14 to be fitted into the female connector 11.

Figure 10:
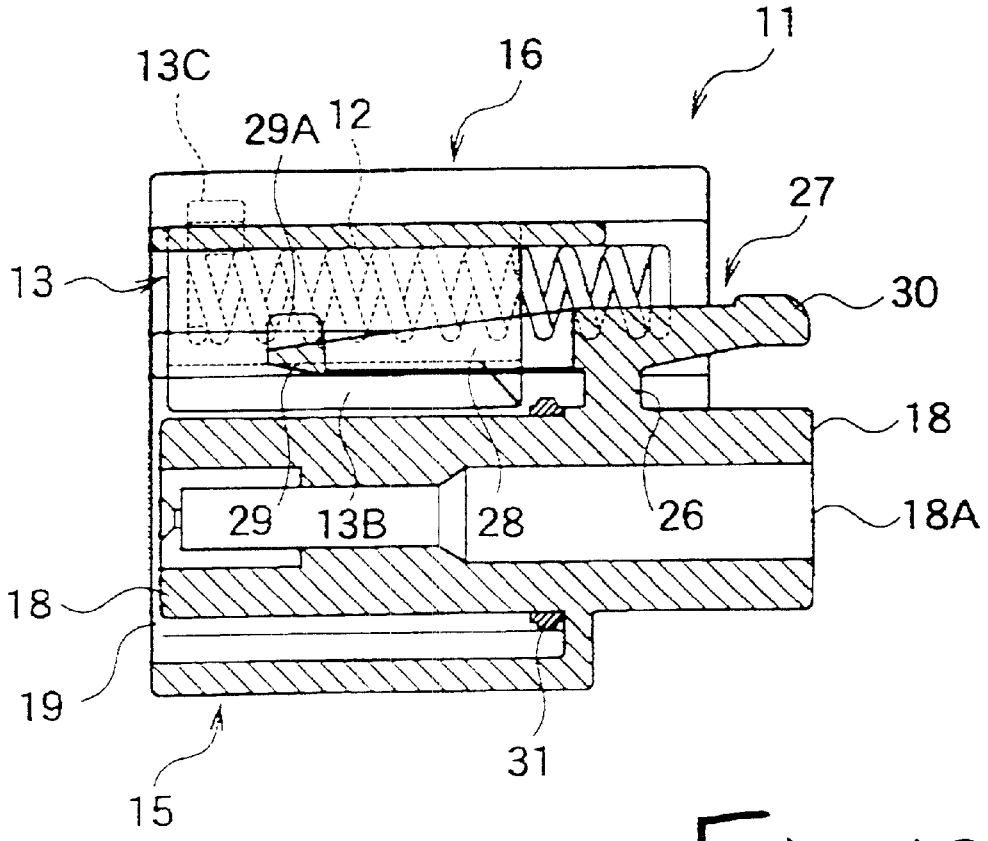
FIG. 10 is a sectional view cut along a line B—B in FIG. 9.
Figure 11:
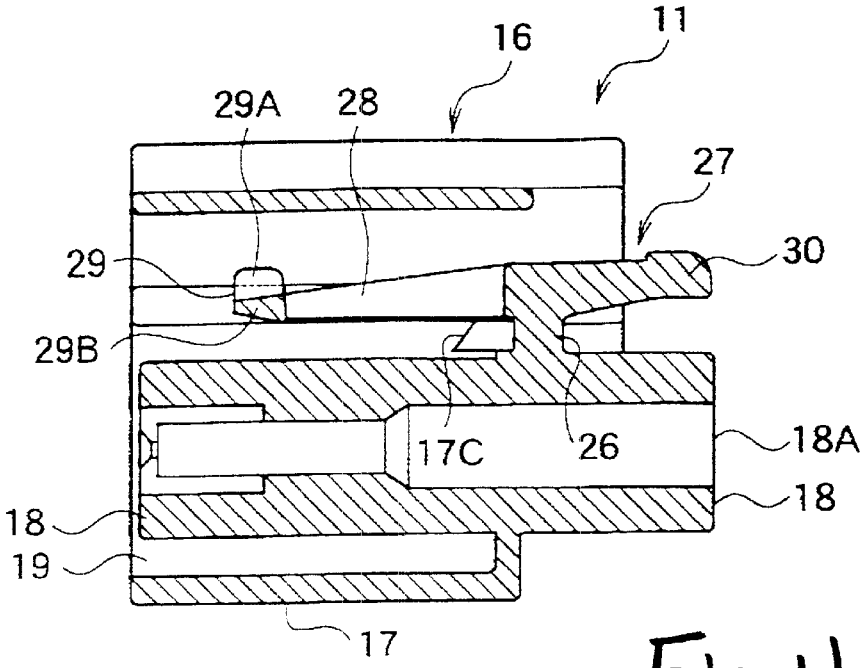
FIG. 11 is a longitudinal sectional view of the female connector in the embodiment.

The female connector 11 is provided with a female connector housing 17 in which a male connector insertion portion 15 and a slider insertion portion 16 are formed. A female coupling terminal housing portion 18 is disposed within the male connector insertion portion 15 of the female connector housing 17 so that the periphery thereof is separated from the female connector housing 17 and a male connector insertion space 19. As shown in FIG. 10, a packing 31 is provided at the female coupling terminal housing portion 18 at the innermost portion of the male connector insertion space 19 so as to surround the periphery thereof. The rear end portion of the female coupling terminal housing portion 18 is formed so as to protrude backward from the female connector housing 17. A female coupling terminal 18A is inserted within the female coupling terminal housing portion 18 from the rear direction thereof and fixed thereto.

Figure 6:
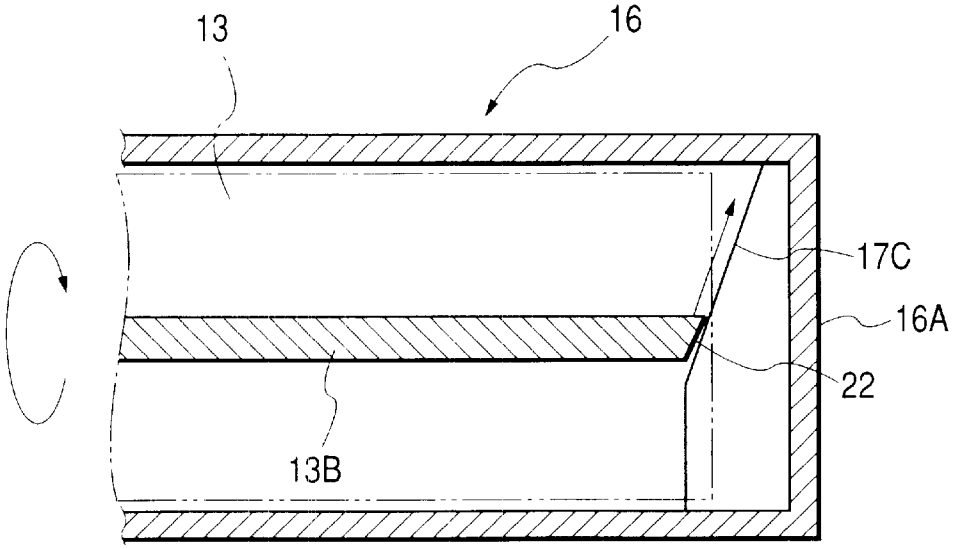
FIG. 6 is a horizontal sectional view showing a state where the slider is inserted into a slider insertion portion in the embodiment.
Figure 8:
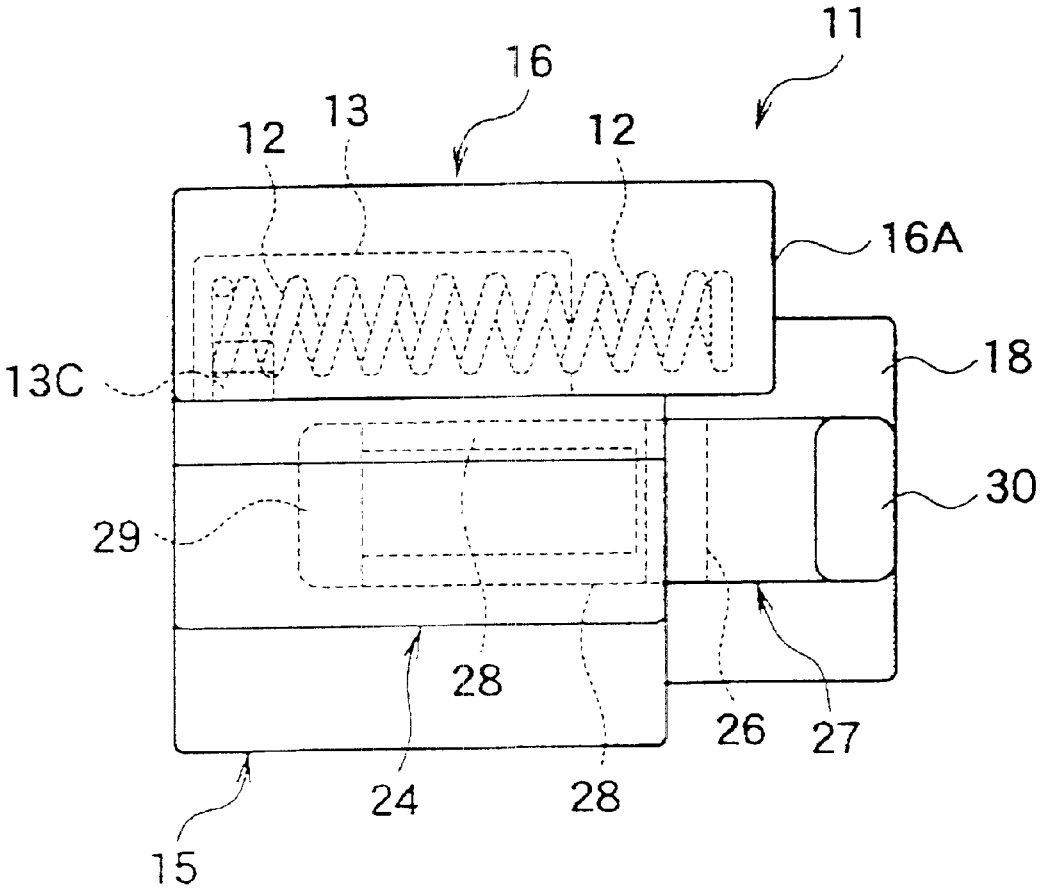
FIG. 8 is a plan view showing a state where the slider is inserted and disposed in the female connector in the embodiment.

The slider insertion portion 16 of the female connector 11 is formed at the upper portion of the one side along the width direction of the female connector housing 17. A slider insertion space 20 of an almost column shape is formed within the slider insertion portion. The slider insertion portion 16 is opened at the front end side of the female connector 11 and closed at the rear end side. That is, as shown in FIGS. 6 and 8, a rear wall portion 16A is formed at the rear end portion of the slider insertion portion 16 and the one end portion of the coil spring 12 abuts against the inner side surface of the rear wall portion 16A.

Further, a locking mechanism portion 24 is provided at the upper portion of the male connector insertion portion 15 of the female connector 11 and the side direction of the slider insertion portion 16.

Figure 2:
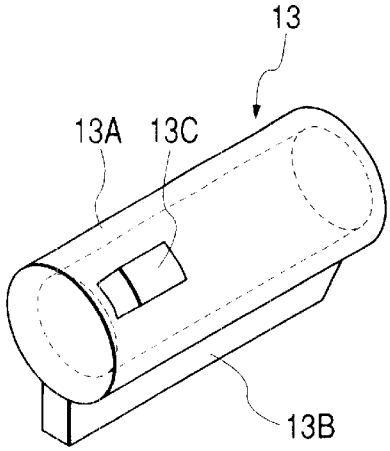
FIG. 2 is a perspective view of a slider used in the embodiment.
Figure 3:
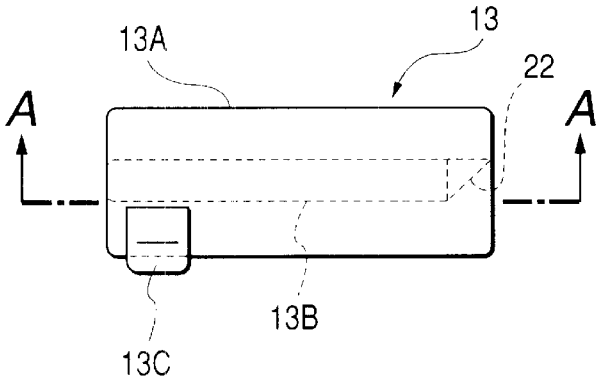
FIG. 3 is a plan view of the slider used in the embodiment.
Figure 4:
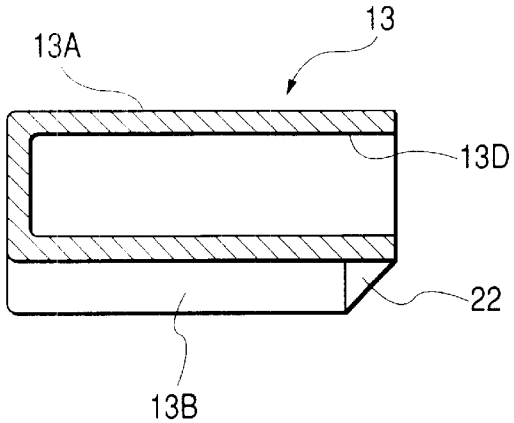
FIG. 4 is a sectional view cut along a line A—A in FIG. 3.
Figure 5:
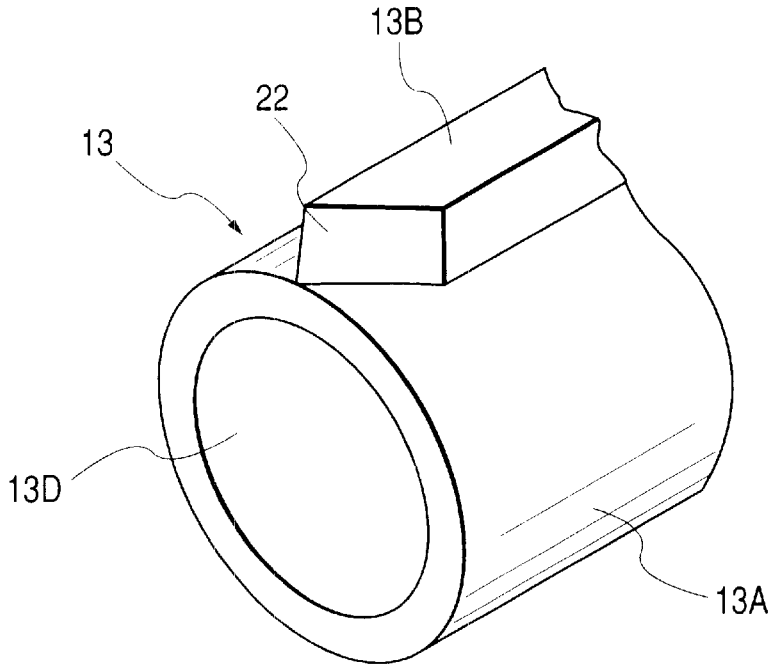
FIG. 5 is a perspective view showing the rear end portion of the slider used in the embodiment.

The construction of the slider 13 will be explained with reference to FIGS. 1 to 5 before the explanation of the construction within the slider insertion portion 16. In this respect, FIG. 2 is a perspective view of the slider 13, FIG. 3 is a plan view of the slider 13, FIG. 4 is a sectional view along a line A—A in FIG. 3 and FIG. 5 is a perspective view showing the rear end portion of the slider 13.

The slider 13 is provided with a slider main body 13A of a cylindrical shape whose front end surface is closed and the rear end surface thereof is opened, an abutment projection 13B formed on the peripheral surface of the slider main body 13A along the axial direction thereof so as to protrude below from the front end of the slider main body 13A to the rear end thereof, and an upper projection 13C protruding outside (almost upper direction) from the upper peripheral wall of the front end portion of the slider main body 13A. A spring insertion space 13D for housing the coil spring 12 is formed within the slider main body 13A. As shown in FIGS. 4 and 5, the spring insertion space 13D is opened at the rear end surface of the slider main body 13A. In this embodiment, the upper projection 13C is set to the position at an angle of about 135 degrees with respect to a plane coupling between the axis of the slider main body 13A and the abutment projection 13B. Further, a projection side tapered surface 22 is formed at the rear end portion of the abutment projection 13B along the inner peripheral surface within the slider insertion portion 16 of the female connector 11 so as to be guided along the rotational direction of the slider 13.

Then, the construction of the slider insertion portion 16 on the female connector 11 side in which the slider 13 is inserted will be explained with reference to FIGS. 1, 6, 7 and 9 to 11. FIG. 10 is a sectional view along a line B—B in FIG. 9.

Figure 7:
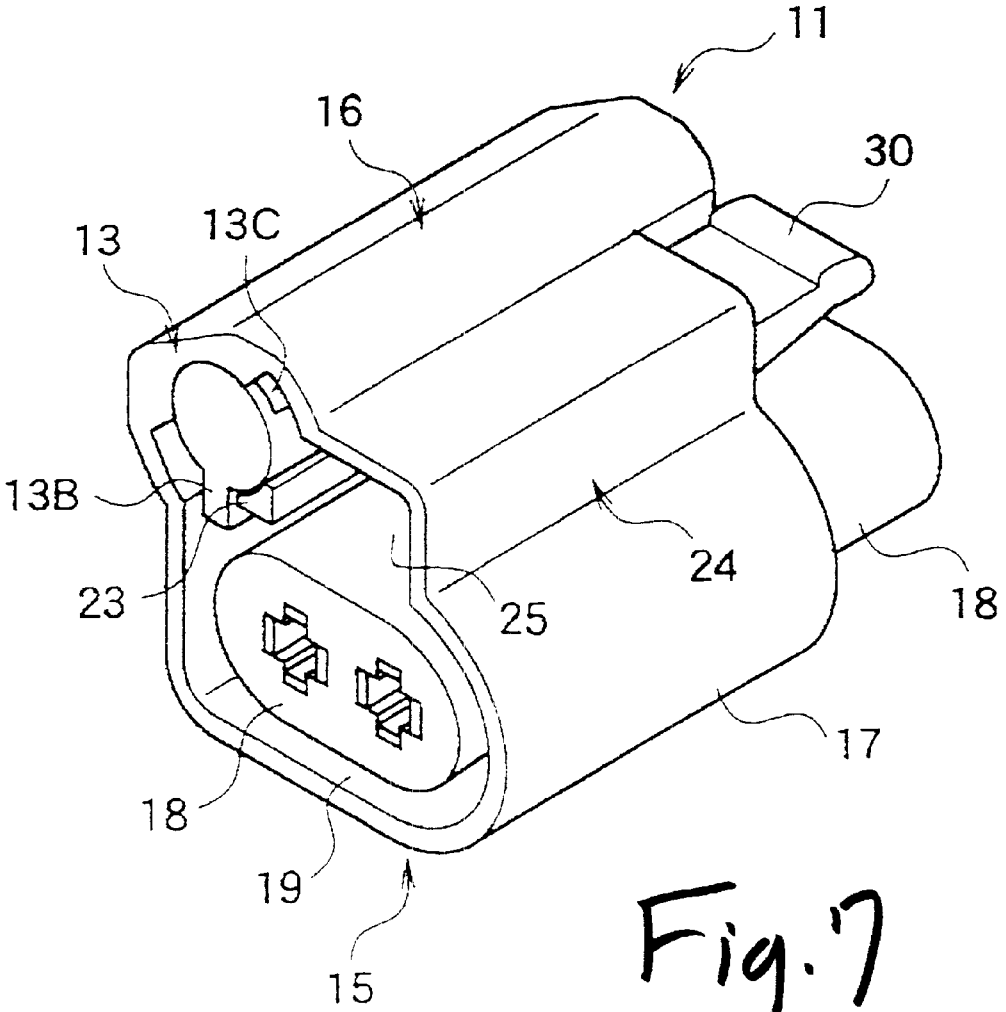
FIG. 7 is a perspective view showing a state where the slider is inserted and disposed in a female connector in the embodiment.
Figure 9:
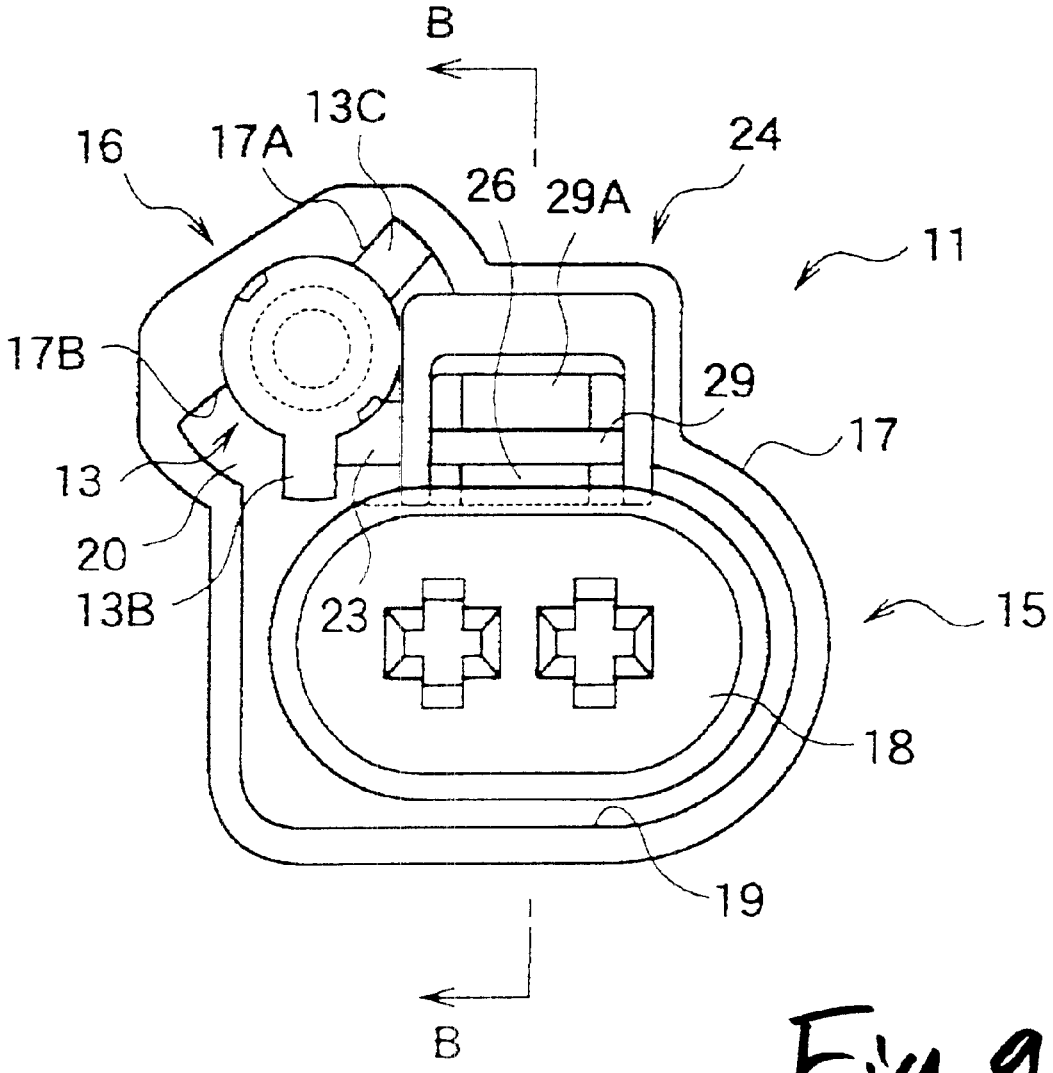
FIG. 9 is a plan view showing a state where a male connector is coupled to the female connector in the embodiment.

As shown in FIGS. 1, 7 and 9, a slider contact plate 23 contacting to the peripheral surface of the slider 13 is provided at the lower portion of the slider insertion space 20 along the depth direction of the slider insertion space 20. The slider contact plate 23 is provided integrally with the female connector housing 17 so as not to interfere with the male connector insertion space 19 and the slider insertion space 20. The upper surface of the slider contact plate 23 forms a curved surface 23A which is curved along the peripheral surface of the slider 13.

Further, as shown in FIG. 9, when the slider 13 is inserted into the slider insertion portion 16 in a state that the abutment projection 13B is directed downward, the abutment projection 13B abuts against the slider contact plate 23 and the upper projection 13C abuts against the upper inner wall 17A of the slider insertion portion 16, whereby the slider is prevented from rotating counterclockwise. Further, in this state, the abutment projection 13B and the upper projection 13C are set to be rotatable by a predetermined angle (about 45 degrees in the embodiment) clockwise. When the slider 13 rotates clockwise, the abutment projection 13B abuts against the lower inner wall 17B of the slider insertion portion 16, so that the slider is prevented from rotating furthermore.

Further, as shown in FIG. 6, an surface 17 is formed at the inner peripheral surface of the slider insertion portion 16 so as to abut against the projection side tapered surface 22 formed at the rear end surface of the abutment projection 13B of the slider 13. In this respect, FIG. 6 shows a state that the female connector housing 17 of the slider insertion portion 16 is cut along the horizontal direction.

Next, the configuration of the locking mechanism portion 24 will be explained. The locking mechanism portion 24 is disposed at the position which is above the male connector insertion portion 15 of the female connector 11 and at the side portion of the slider insertion portion 16 and also which is at a locking mechanism housing space 25 for communicating the male connector insertion space 19 with the slider insertion space 20.

Figure 12:
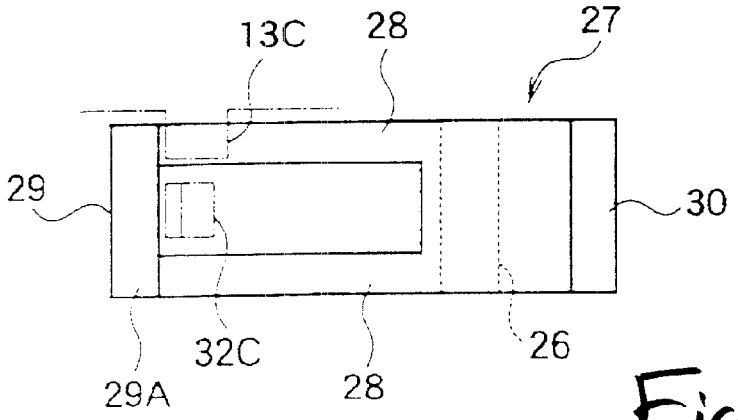
FIG. 12 is an explanatory plan view showing the relation among a locking piece, an upper projection and an engagement projection in the embodiment.

Within the locking mechanism housing space 25, a locking piece 27 is integrally provided along the longitudinal direction at the upper end of a resilient supporting plate 26 which is provided so as to elect from the upper portion of the female coupling terminal housing portion 18. As shown in FIG. 12, the portion of the locking piece 27 on the front side from the supporting plate 26 includes a pair of arm portions 28 which are extended in parallel to each other to the front side from the both sides of the supporting plate 26, and a latching portion 29 which are provided to bridge the tip end portions of the arm portions 28. An upper projection latching portion 29A is integrally formed at the upper portion of the latching portion 29 so as to protrude upward therefrom. A guide tapered surface 29B is formed at the lower surface of the front end side of the latching portion 29 so as to guide an engaging projection 32C formed at the upper portion of the male connector 14 (described later) to the inner side. Further, the latching portion 29 is usually disposed at the position close to the upper surface of the female coupling terminal housing portion 18 so that, when the male connector 14 is inserted into the female connector, the engaging projection 32C pushes up the latching portion 29 and passes therethrough, and the latching portion 29 moves downward again when the engaging projection 32C has passed the latching portion 29, whereby the engaging projection 32C engages with the latching portion 29 thereby to be prevented from returning as shown in FIG. 12.

The portion of the locking piece 27 at the rear side from the supporting plate 26 is extended backward to form an operation plate portion 30 which protrudes outside of the locking mechanism housing space 25. When the operation plate portion 30 is pushed so as to be closed to the female coupling terminal housing portion 18, the arm portions 28 is moved upward with respect to the upper portion of the supporting plate 26 serving as a fulcrum.

Figure 13:
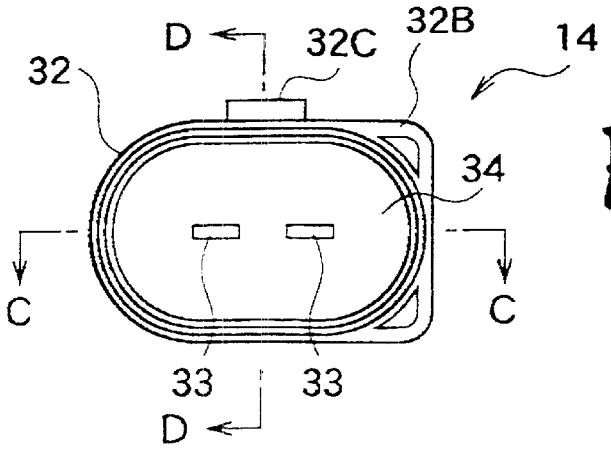
FIG. 13 is a plan view showing the male connector in the embodiment.
Figure 14:
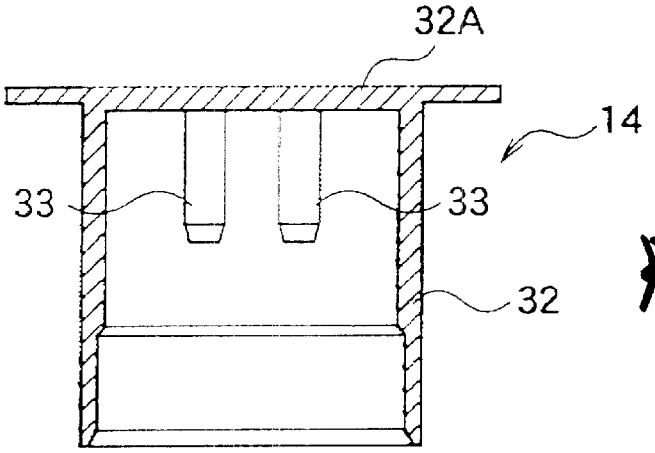
FIG. 14 is a sectional view cut along a line C—C in FIG. 13.
Figure 15:
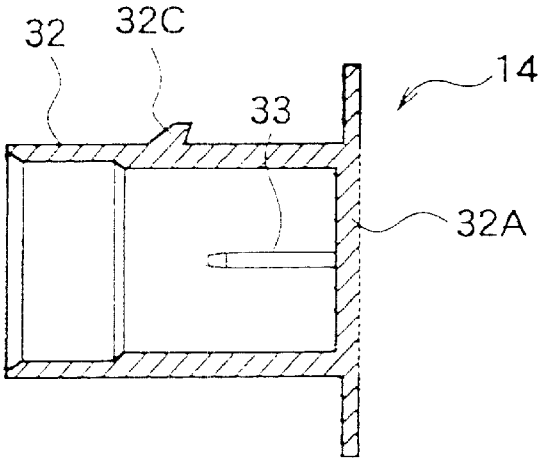
FIG. 15 is a sectional view cut along a line D—D in FIG. 13.

Next, the configuration of the male connector 14 will be explained with reference to FIGS. 1 and 13 to 15. FIG. 14 is a sectional diagram cut along a line C—C in FIG. 13 and FIG. 15 is a sectional diagram cut along a line D—D in FIG. 13. The male connector 14 is almost configured by a male connector housing 32 and male coupling terminals 33 disposed in an inner space 34 within the male connector housing 32. The male connector housing 32 is inserted in the male connector insertion space 19 of the female connector 11 and formed in a cylindrical configuration of an almost elliptical shape in section so as to fit to the female coupling terminal housing portion 18. A tapered surface is formed at the inner side surface of the front end opening portion of the male connector housing 32 so that the female coupling terminal housing portion 18 can be fitted easily. As shown in FIGS. 14 and 15, the male coupling terminals 33 are disposed so as to penetrate a wall portion 32A at the rear end portion (base portion) side of the male connector housing 32 and protrude within the inner space 34. Further, as shown in FIG. 13, an abutment portion 32B is formed at the one side edge portion of the upper portion of the male connector housing 32 so that it abuts against the front end portion of the abutment projection 13B of the slider 13 which is inserted in the slider insertion portion 16 of the female connector 11 when the male connector is inserted into the female connector 11. Furthermore, the engaging projection 32C engaging with the latching portion 29 of the aforesaid locking mechanism is protrusively provided at the almost center portion of the upper surface of the male connector housing 32.

The function and operation of the connector 10 according to this embodiment will be explained.

First, as shown in FIG. 1, prior to the coupling of the connectors, the coil spring 12 and the slider 13 are sequentially inserted from the front end side of the female connector 11 into the slider insertion space 20 of the slider insertion portion 16 of the female connector 11. In this case, as shown in FIGS. 8 and 10, the coil spring 12 is housed within the spring insertion space 13D of the slider 13. In the state where the slider 13 is inserted into the spring insertion space 13D in this manner, the spring is not urged and so the repulsive force thereof is not generated.

Figure 16:
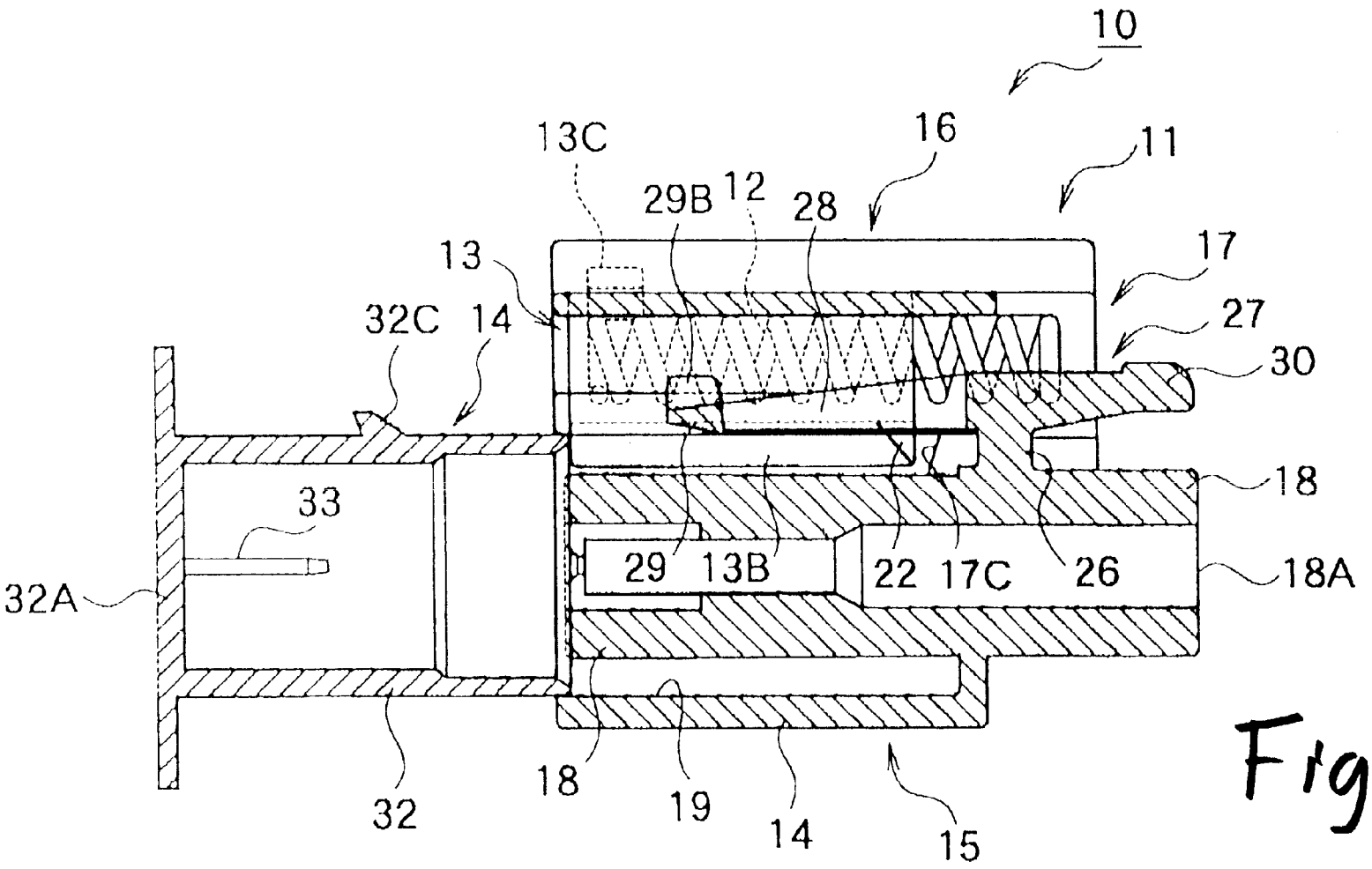
FIG. 16 is a longitudinal sectional view showing a fitting operation start state between the female connector and the male connector in the embodiment.
Figure 17:
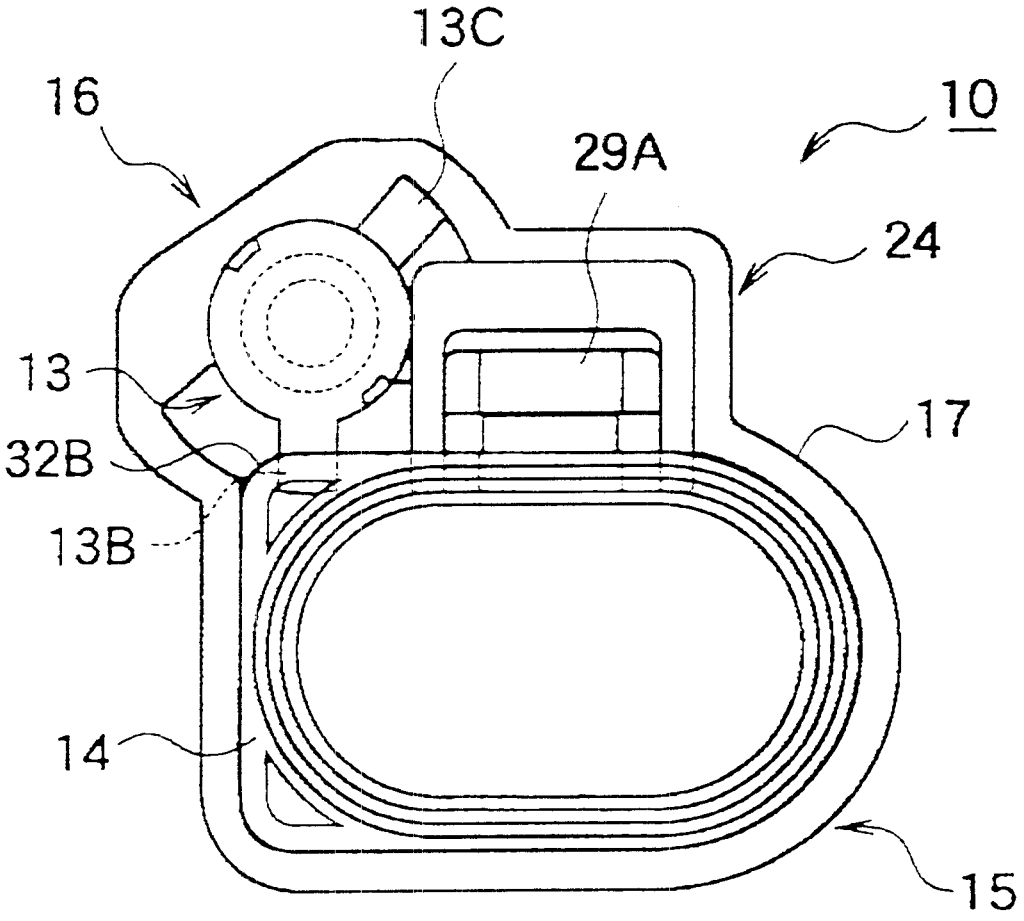
FIG. 17 is a front view showing the fitting operation start state between the female connector and the male connector in the embodiment.

Next, as shown in FIG. 16, the male connector 14 is aligned with the front end of the male connector insertion portion 15 of the female connector 11 and inserted therein, the abutment portion 32B of the male connector housing 32 abuts against the front end of the abutment projection 13B of the slider 13. FIG. 17 shows a front view of the male connector 14 when seen from the backward side thereof.

Figure 18:
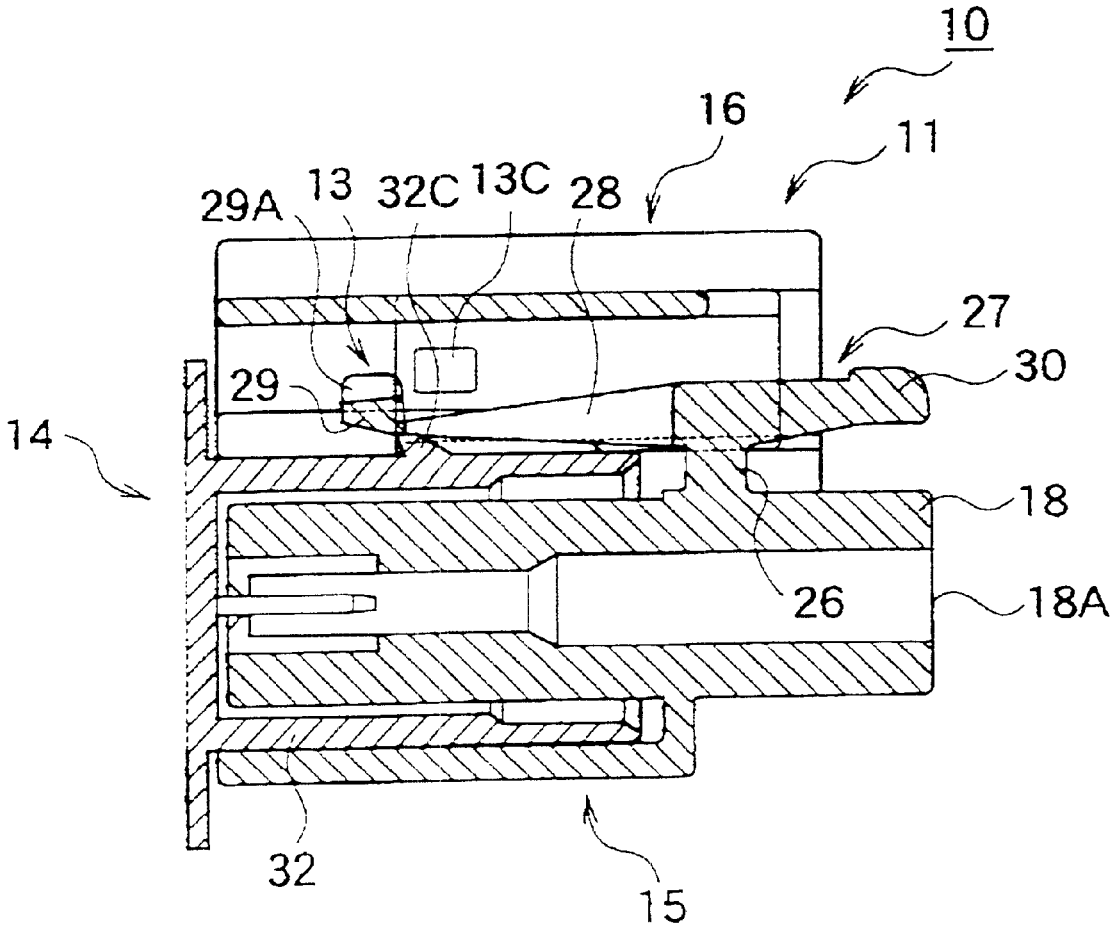
FIG. 18 is a longitudinal sectional view showing the fitting operation start state in the embodiment.
Figure 19:
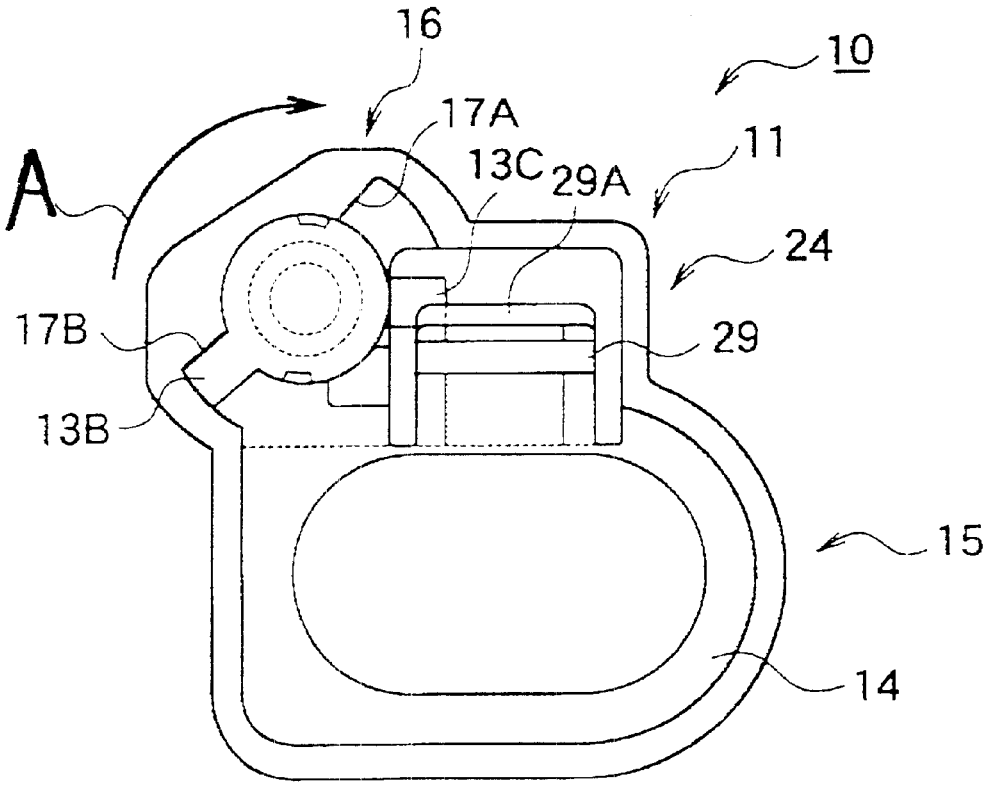
FIG. 19 is a front view showing a half-fitting state in the embodiment.

When the male connector 14 is further inserted, as shown in FIG. 18, the slider 13 moves into the inner portion of the slider insertion space 20 together with the male connector 14 and the upper projection 13C of the slider 13 passes the upper projection latching portion 29A. In accordance with such an operation, the projection side tapered surface 22 formed at the rear end of the abutment projection 13B of the slider 13 moves along an insertion portion side tapered surface 17C formed at the female connector housing 17. Then, the slider 13 rotates in the direction shown by an arrow A in FIG. 19 and so the abutment projection 13B abuts against the lower inner wall 17B of the female connector housing 17. Further, as shown in FIG. 19, the upper projection 13C rotates in the direction shown by the arrow A on the rear side of the upper projection latching portion 29A. As a result, the slider 13 stops its rotation and is pushed back by the repulsive force of the coil spring 12. However, since the upper projection 13C is stopped by the upper projection latching portion 29A, the slider can not be restored to the initial state at the slider insertion portion 16 in such a half-fitting state as shown in FIG. 18 (the engaging projection 32C formed at the upper surface of the female connector housing 17 is positioned beneath the latching portion 29 on the way of fitting operation).

Figure 20:
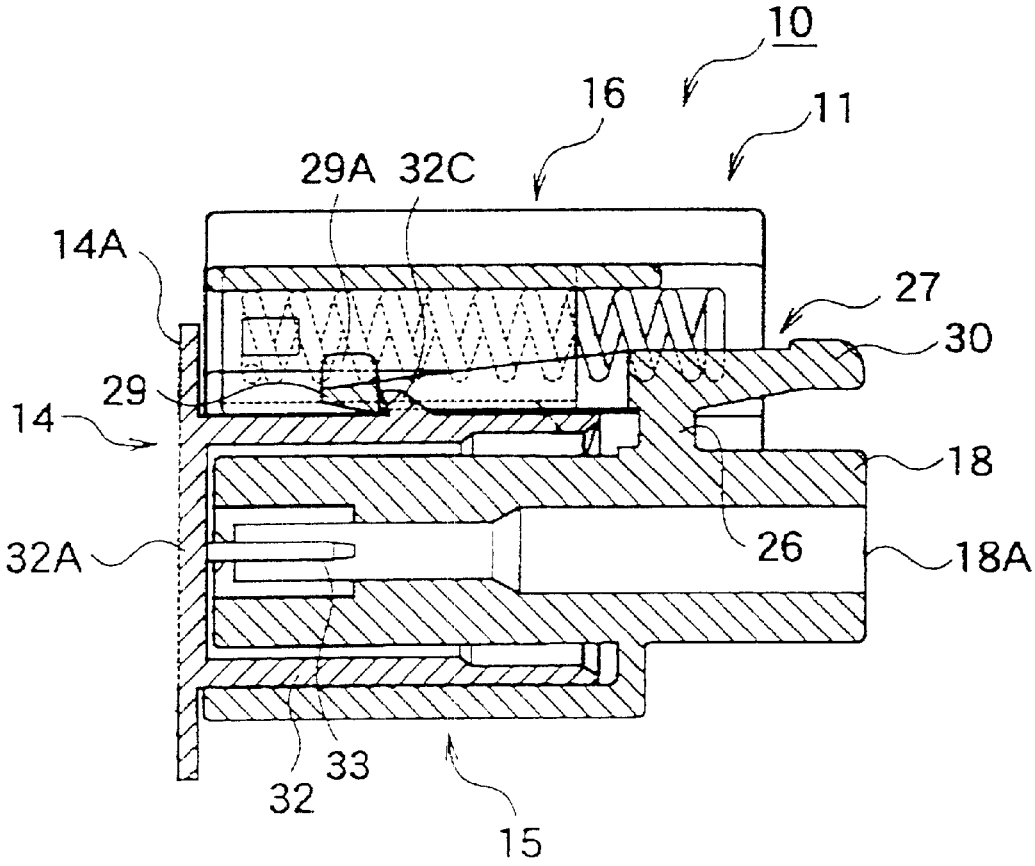
FIG. 20 is a longitudinal sectional view showing a completely fitting state in the embodiment.
Figure 21:
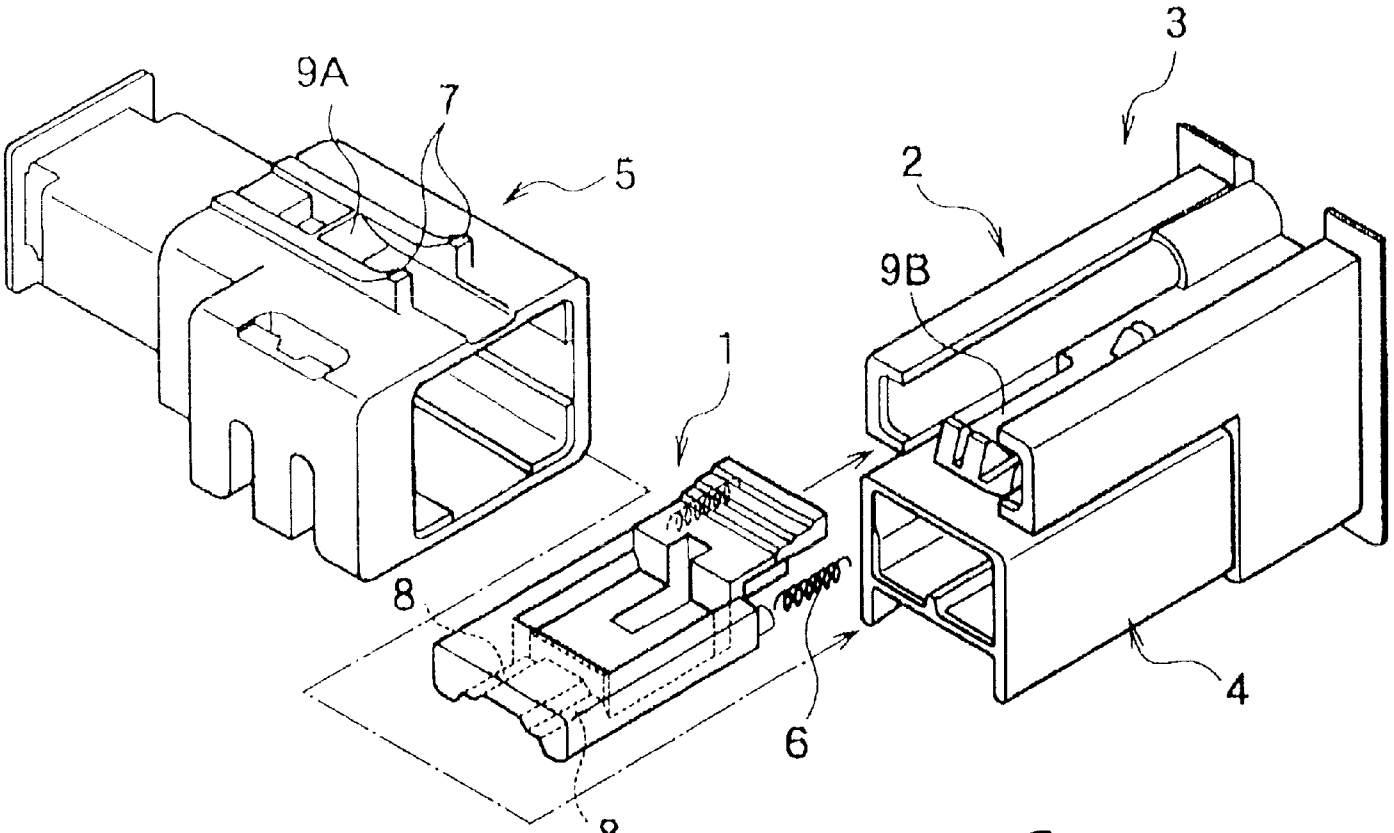
FIG. 21 is an exploded perspective view showing a related connector.

FIG. 20 shows a state where the engaging projection 32C has passed beneath the latching portion 29 after the upper projection 13C passed the upper projection latching portion 29A. At this time, since the engaging projection 32C is positioned at the rear side of the latching portion 29 and stopped thereby, the male connector 14 is prevented from coming out of the female connector. in this respect, when the upper projection latching portion 29A moves downward, the upper projection 13C of the slider 13 is released from the interference of the upper projection latching portion 29A and so returned to the initial position by the repulsive force of the coil spring 12. However, as shown in FIG. 20, since the slider 13 abuts against the flange portion 14A of the base portion of the male connector 14, the slider is prevented from coming out of the slider insertion portion 16.

In this manner, the coupling between the male connector 14 and the female connector 11 is completed. In order to release the coupling between the male connector 14 and the female connector 11, the operation plate portion 30 of the locking piece 27 is pushed so as to make it close to the female coupling terminal housing portion 18. Thus, the arm portion 28 of the locking piece 27 moves upward to release the engaging projection 32C on the male connector 14 side from the latching portion 29, whereby the male connector 14 can be come out of the female connector.

In this embodiment, when the female and male connectors 11 and 14 are in a half-fitting state, two functions explained below are performed. First, in such a half-fitting state that the engaging projection 32C of the male connector 14 does not reach to the latch portion 29, since the slider 13 abuts against the abutment portion 32B of the male connector housing 32, when the coupling operation of the connector is stopped in the middle of the coupling operation (released from the hand), the male connector 14 is pushed back by the repulsive force of the coil spring 12 through the slider 13, whereby the incompletion state of the fitting operation can be determined at a glance.

Further in such a half-fitting state that the engaging projection 32C is positioned beneath the latching portion 29 and the upper projection latching portion 29A moves upward, the upper projection 13C of the slider 13 is rotated and is interfered by the upper projection latching portion 29A, so that the slider 13 can not be returned to the initial state. Thus, a coupling operator can easily determine that the slider is not returned to the initial state from a fact that none of an operation sound generated when the slider 13 returns nor a sound generated by collision of the slider 13 when it returns is generated. When the upper projection 13C passes the latching portion 29 and the upper projection latching portion 29A is moved downward, since there is nothing interfering the returning operation of the upper projection 13C, the slider 13 is returned to the initial state by the repulsive force of the coil spring 12. Then, the completion of the fitting operation between the female and male connectors 11 and 14 can be determined from the sound which is generated when the slider collides with the portion 14A of the male connector 14.

According to such an embodiment, since the slider 13, which makes it possible to detect the half-fitting state as described above, is disposed at the slider insertion portion 16 located at the side portion of the locking mechanism portion 24 for housing the locking mechanism, the size of the height of the connector can be advantageously prevented from being increased when compared with the related structure where the slider is disposed above the locking arm. Further, since the slider 13 may not be a thin almost cylindrical shape, the detecting means for detecting the half-fitting state of the slider 13 can be advantageously assembled compactly at the side portion of the locking mechanism portion 24.

Further, according to the embodiment, since the engaging projection 32C may be protrusively provided at one portion on the upper surface of the male connector 14, the configuration of the male connector 14 can be made quite simple. Thus, the male connector 14 may be used for a so-called complete fitting type connector to be fitted with the female connector 11 having the locking mechanism portion 24 and the slider insertion portion 16 like the present embodiment or for a so-called semi-fitting type connector to be merely fitted with the female coupling terminal housing portion 18, so that the general-purpose property of the male connector 14 can be enhanced. In this manner, according to the embodiment, the female connector housing 17 can be prevented from being enlarged in its size and complicated in its configuration and also the male connector housing 32 can be made simple in its configuration.

Although the explanation has been made as to the embodiment, the invention is not limited thereto and various modification according to the gist of the configuration of the invention may be performed. For example, although in the aforesaid embodiment, one of the connectors is the female connector 11 and the other is the male connector 14, the relation between the one and the other connectors may be vise versa.

What is claimed is:

1. A connector comprising:

a first connector including a connector insertion portion and a slide member insertion portion adjacent to the connector insertion portion;

a second connector to which the first connector is fitted in a fitting direction;

a locking mechanism including a locking member provided at a side portion of the connector insertion portion for holding a state where the first and second connectors are fitted each other in a fitted state;

a slide member including an elastic member which is provided in and slidable along the slide member insertion portion, wherein the elastic member urges the second connector in a direction opposite to the fitting direction by its repulsive force when the first and second connectors are half-fitted each other in a half-fitted state; and a rotation guide mechanism, for rotating the slide member by a predetermined angle in accordance with a movement of the slide member in the fitting direction, provided at the slide member insertion portion and the slide member, wherein the slide member can be engaged with the locking mechanism in accordance with the rotation of the slide member.

2. The connector according to claim 1, wherein the slide member includes an abutment projection which abuts against the second connector upon fitting of the first and second connectors and a projection which is engaged with the locking mechanism in accordance with the rotation of the slide member.

3. The connector according to claim 1, wherein the rotation guide mechanism is formed by a first guided surface formed at a front end portion of the slide member in the fitting direction and a second guide surface formed at the slide member insertion portion for rotating the slide member in contact with the first guided surface in accordance with sliding movement of said slide member.

4. The connector according to claim 2, wherein the locking member is formed by a supporting portion formed at a housing of the first connector and a locking piece extended in the fitting direction, the locking piece has a predetermined flexibility for almost integrally swinging front and rear portions of the locking piece with respect to the supporting portion, and includes a latching portion and a projection latching portion which are provided the front portion of the locking piece, the latching portion is engaged with an engagement projection protruded from a housing of the second connector in the fitted state, and the projection latching portion interferes the sliding movement of the slide member in the half-fitted state.

5. The connector according to claim 4, wherein the engagement projection pushes the latching portion in a direction substantially perpendicular to the fitting direction and passes the latching portion therethrough, and the projection of the slide member abuts against the projection latching portion in the half-fitted state.

6. The connector according to claims 1, wherein the slide member is a cylindrical shape, the elastic member is a coil spring, and the elastic member is inserted from a rear end side of the slider member.

* * * * *